US012709501B2

(12) United States Patent
Seto

(10) Patent No.: US 12,709,501 B2
(45) Date of Patent: Aug. 18, 2026

(54) ACCOMMODATION SYSTEM INCLUDING ACCOMMODATION UNIT THAT ACCOMMODATES RECORDING MATERIAL

(71) Applicant: CANON KABUSHIKI KAISHA, Tokyo (JP)

(72) Inventor: Masaki Seto, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 11 days.

(21) Appl. No.: 18/958,441

(22) Filed: Nov. 25, 2024

(65) Prior Publication Data

US 2025/0171257 A1 May 29, 2025

(30) Foreign Application Priority Data

Nov. 28, 2023 (JP) ..... 2023-200407

(51) Int. Cl.
*B65H 1/26* (2006.01)

(52) U.S. Cl.
CPC ..... *B65H 1/266* (2013.01); *B65H 2405/31* (2013.01)

(58) Field of Classification Search
CPC .... B41J 29/026; B65H 1/266; B65H 2402/10; B65H 2402/32; B65H 2402/44; B65H 2402/442; B65H 2405/31; B65H 2601/322
See application file for complete search history.

(56) References Cited

U.S. PATENT DOCUMENTS 5,593,152 A * 1/1997 Wirth ..... B65H 1/266 271/241
2009/0001657 A1* 1/2009 Yamaguchi ..... B65H 1/266 271/164
2009/0218755 A1 9/2009 Nishitani
2013/0049292 A1* 2/2013 Totsuka ..... B65H 1/00 271/164
2013/0221600 A1 8/2013 Kotaka
2014/0001696 A1* 1/2014 Yoshida ..... B65H 1/266 271/9.01
2014/0191463 A1 7/2014 Totsuka
2016/0159589 A1 6/2016 Kuwata
2018/0118478 A1 5/2018 Yamaguchi

FOREIGN PATENT DOCUMENTS

JP 57166236 A * 10/1982 ..... B65H 1/26
JP 2007062937 A 3/2007
JP 2007062993 A 3/2007
JP 2008254874 A 10/2008
JP 2008308250 A 12/2008
JP 2016108080 A 6/2016
JP 2016156847 A 9/2016

* cited by examiner

*Primary Examiner* — Prasad V Gokhale

(74) *Attorney, Agent, or Firm* — Canon U.S.A., Inc. I.P. Division

(57) ABSTRACT

The present invention guides an accommodation portion so that its insertion is not hindered when inserting it into a housing. An accommodation system includes an accommodation unit to hold recording material and a connection unit connected to the lower part of the accommodation unit. The accommodation unit includes a housing and an accommodation portion to hold the recording material and move between a first position pulled out from the housing and a second position inserted into the housing. The connection unit includes a guide portion to guide the accommodation portion's movement. In moving from the first to the second position, the accommodation portion contacts the guide portion and is guided upward.

9 Claims, 12 Drawing Sheets

ACCOMMODATION SYSTEM INCLUDING ACCOMMODATION UNIT THAT ACCOMMODATES RECORDING MATERIAL

BACKGROUND OF THE INVENTION

Field of the Invention

The present invention relates to an accommodation system including an accommodation unit that accommodates a recording material.

Description of the Related Art

An image formation apparatus discussed in Japanese Patent Publication Laid-Open No. 2016-108080 includes an accommodation unit capable of accommodating a recording material and a connection unit connected to a lower portion of the accommodation unit, as an option of the image formation apparatus. The accommodation unit includes an accommodation portion that accommodates the recording material and a housing that supports the accommodation portion, and the accommodation portion can be pulled out from and inserted into the housing.

In the image formation apparatus, it is desirable that the accommodation portion is guided in such a manner that the insertion of the accommodation portion is not hindered when the accommodation portion hangs down due to a self-weight at the time of insertion of the accommodation portion.

SUMMARY OF THE INVENTION

Accordingly, the present invention is directed to guiding the accommodation portion in such a manner that the insertion of the accommodation portion is not hindered in the process of inserting the accommodation portion into the housing.

One embodiment of the present invention is as follows.

According to an aspect of the present invention, an accommodation system includes an accommodation unit configured to accommodate a recording material and a connection unit configured to be connected to a lower portion of the accommodation unit. The accommodation unit includes a housing, and an accommodation portion configured to accommodate the recording material and to be movable between a first position where the accommodation portion is pulled out from the housing and a second position where the accommodation portion is inserted into the housing. The connection unit includes a guide portion configured to guide a movement of the accommodation portion. In a process of the accommodation portion moving in a first direction where the accommodation portion moves from the first position to the second position, the accommodation portion comes into contact with the guide portion and is guided upward.

Further features of the present invention will become apparent from the following description of exemplary embodiments with reference to the attached drawings.

DESCRIPTION OF THE EMBODIMENTS

Hereinafter, a exemplary embodiment of the present invention will be described in detail, by way of example, with reference to the accompanying drawings. Note that, the dimensions, materials, shapes, relative arrangements thereof, and the like of the components described in the following exemplary embodiments should be appropriately changed depending on the configuration of the apparatus to which the present invention is applied and various conditions, and the scope of the present invention is not limited to them alone.

In the following description and the drawings, a vertical direction in a case where an image formation unit 1 is installed on a horizontal plane is defined as a Z direction. A direction intersecting with the Z direction, that is, a pull-out direction and an insertion direction of an accommodation portion 30 described below is defined as an X direction. A direction intersecting with both the Z direction and the X direction is defined as a Y direction.

The axial direction of a photosensitive drum 51 described below is the Y direction. The X and Y directions are preferably horizontal. Further, the X direction, the Y direction, and the Z direction are preferably orthogonal to each other. In addition, as necessary, directions of arrows X, Y, and Z illustrated in each drawing are respectively referred to as a +X side, a +Y side, and a +Z side, and opposite sides thereof are respectively referred to as a −X side, a −Y side, and a −Z side. In the following description, the +X direction may be referred to as a first direction, but the +X direction and the first direction are the same direction.

The first direction is also a direction from a first position to a second position, which will be described below. In the following description, the Y direction may be referred to as a second direction.

<Configuration of Image Forming Unit>

Figure 1:
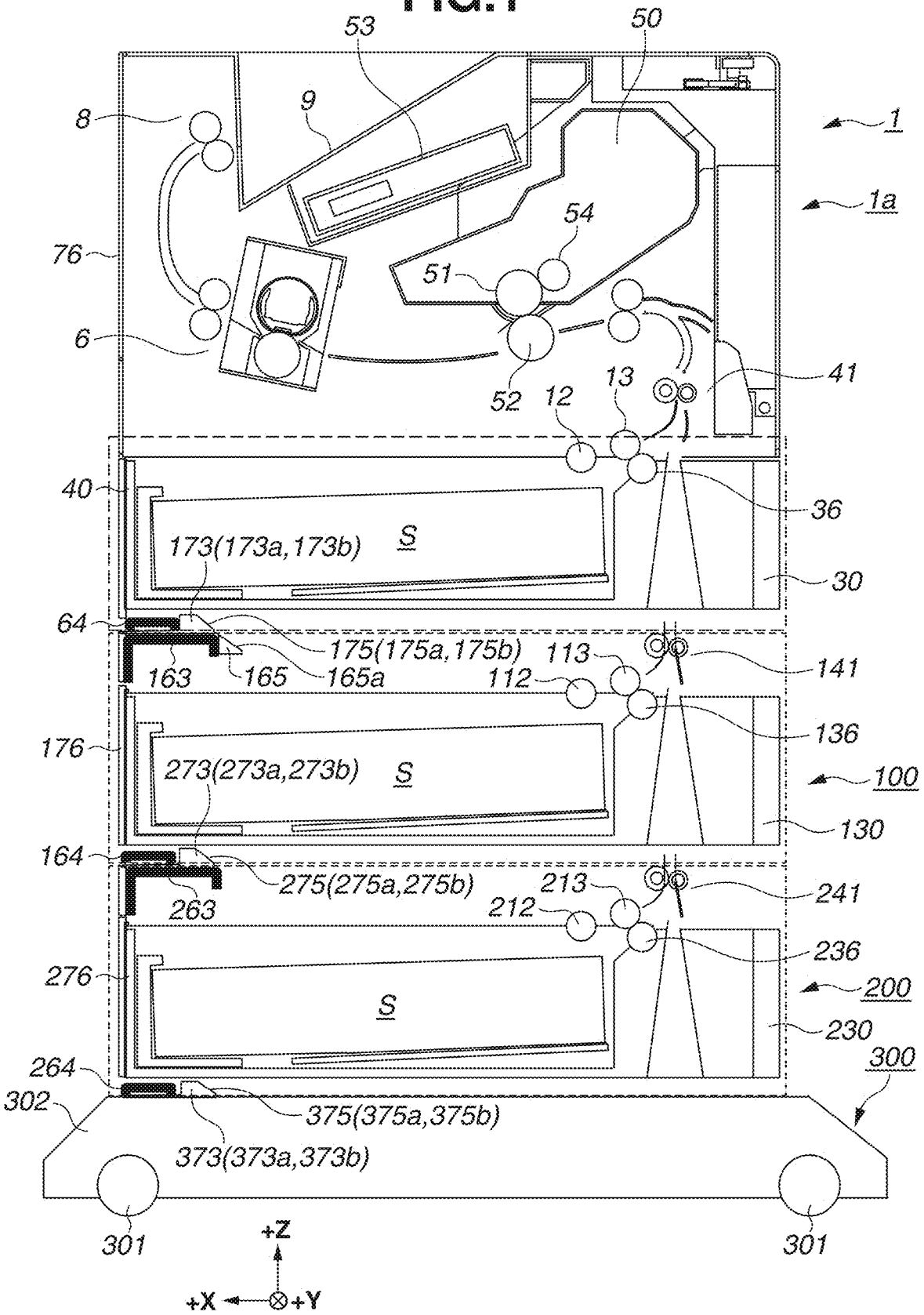
FIG. 1 is a schematic diagram of an image formation unit according to a first exemplary embodiment.

A configuration of the image formation unit 1 will be described with reference to FIG. 1. FIG. 1 is a schematic diagram of an image formation unit 1. The image formation unit 1 is a unit (accommodation system) including an image formation apparatus 1*a*, a first accommodation unit 100, a second accommodation unit 200, and a support unit 300.

The image formation apparatus 1*a* is a monochrome laser beam printer that forms an image on a recording material by an electrophotographic method. In the present exemplary embodiment, the laser beam printer is described as an example, but the present invention can be applied to an image formation apparatus such as a copying machine or an ink jet printer.

The first accommodation unit 100 is a unit that can be connected to a lower portion (end portion on the −Z direction side) of the image formation apparatus 1*a*. The first accommodation unit 100 is an accommodation portion capable of accommodating the recording material, and can convey the recording material toward the image formation apparatus 1*a*. Therefore, by connecting the first accommodation unit 100 to the image formation apparatus 1*a*, it is possible to increase the number of sheets of the recording material to be accommodated, and thus the usability for a user can be improved.

The second accommodation unit 200 is a unit that can be connected to a lower portion (end portion on the −Z direction side) of the first accommodation unit 100. The second accommodation unit 200 is an accommodation portion capable of accommodating the recording material, and can convey the recording material toward the first accommodation unit 100.

Therefore, by connecting the second accommodation unit 200 to the image formation apparatus 1*a*, it is possible to increase the number of sheets of the recording material to be accommodated, and thus the usability for the user can be improved.

The support unit 300 is a unit that can be connected to a lower portion (end portion on the −Z direction side) of the second accommodation unit 200. The support unit 300 is a support portion that supports the image formation apparatus 1*a* to which the first accommodation unit 100 and the second accommodation unit 200 are connected. The support unit 300 is provided with a caster 301 and can move the image formation unit 1, thereby improving the usability for the user.

<Configuration of Image Formation Apparatus>

Next, the image formation apparatus 1*a* will be described with reference to FIG. 1. The image formation apparatus 1*a* includes a housing 76, a cartridge 50, an accommodation portion 30, a paper feed roller 12, a first conveyance roller 13, a separation roller 36, a second conveyance roller pair 41, a transfer roller 52, a fixation unit 6, a discharge roller 8, a stack unit 9, and a scanner 53. Further, the cartridge 50 includes a photosensitive drum 51 and a development roller 54. The accommodation portion 30 is an accommodation portion capable of accommodating a recording material.

Next, an image forming operation of the image formation apparatus 1*a* will be described. The scanner 53 irradiates the photosensitive drum 51 with light corresponding to an image signal to form an electrostatic latent image on the photosensitive drum 51. The development roller 54 develops the electrostatic latent image formed on the photosensitive drum 51 with the developer contained in the cartridge 50. Thus, a toner image is formed on the surface of the photosensitive drum 51.

In parallel with such an image forming operation, the paper feed roller 12 conveys a bundle(S) of the recording materials accommodated in the accommodation portion 30 to the first conveyance roller 13 and the separation roller 36. The separation roller 36 separates one recording material from the bundle of recording materials sent from the paper feed roller 12. The separated recording material is conveyed to the second conveyance roller pair 41 by the first conveyance roller 13 and the separation roller 36. The second conveyance roller pair 41 conveys the recording material to a nip portion formed by the photosensitive drum 51 and the transfer roller 52.

The transfer roller 52 transfers the toner image formed on the photosensitive drum 51 onto the recording material conveyed to the nip portion. The fixation unit 6 fixes the toner image by heating and pressing the recording material to which the toner image has been transferred by the transfer roller 52. Further, the fixation unit 6 conveys the recording material on which the toner image is fixed to a discharge roller 8. The discharge roller 8 discharges the recording material conveyed from the fixation unit 6 to the stack unit 9.

Figure 2A:
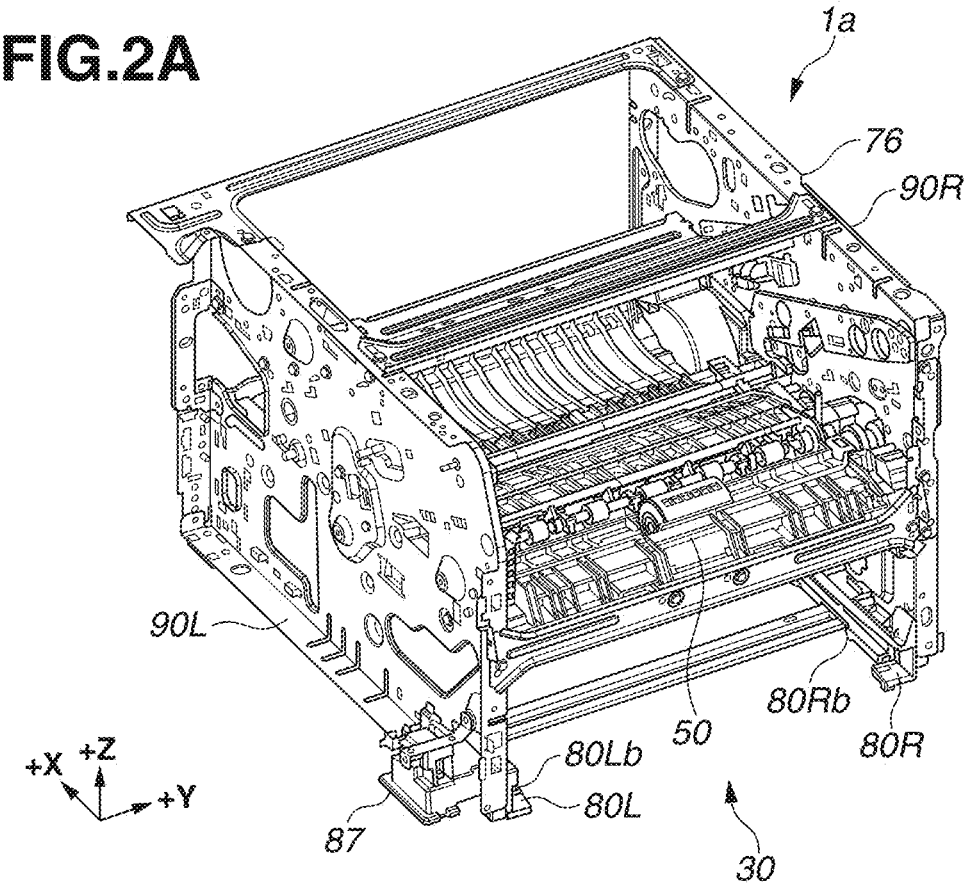
FIGS. 2A and 2B are schematic diagrams of an image formation apparatus according to the first exemplary embodiment.
Figure 2B:
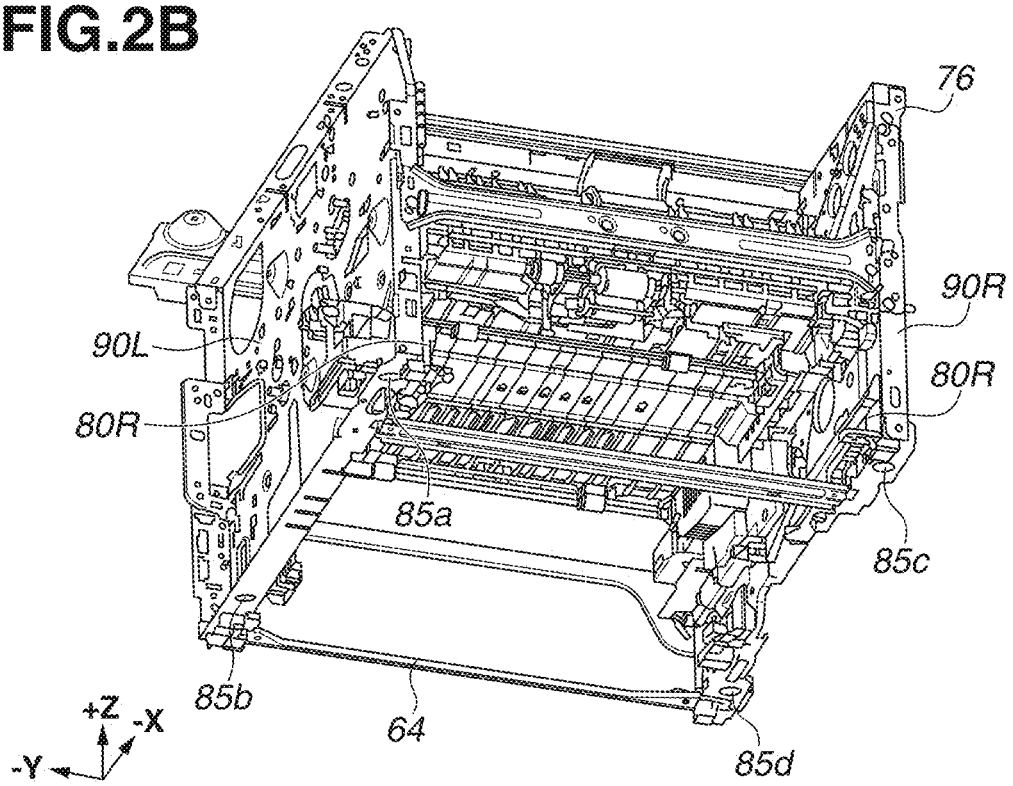

Next, a configuration of the image formation apparatus 1*a* will be described with reference to FIGS. 2A and 2B. FIGS. 2A and 2B are perspective views of the image formation apparatus 1*a*. In FIGS. 2A and 2B, some components of the image formation apparatus 1*a* are omitted.

As illustrated in FIG. 2A, the image formation apparatus 1*a* has a housing 76. The housing 76 has a main body right frame 90R (first frame) and a main body left frame 90L (second frame).

Further, as illustrated in FIG. 2B, the main body right frame 90R has a support portion (right support portion) 80R, a positioning hole 85*c*, and a positioning hole 85*d*. Furthermore, the main body left frame 90L has a support portion (left support portion) 80L, a positioning hole 85*a*, a positioning hole 85*b*, and a connector connection portion 87. In addition, the housing 76 has a connection portion 64.

The main body right frame 90R and the main body left frame 90L are members extending in the X direction and the Z direction, and are formed of a sheet metal in the present exemplary embodiment. The main body right frame 90R supports an end portion of the cartridge 50 on the +Y direction side, and the main body left frame 90L supports an end portion of the cartridge 50 on the −Y direction side. The cartridge 50 is disposed between the main body right frame 90R and the main body left frame 90L in the second direction (Y direction). Further, the cartridge 50 can also be removed from the main body right frame 90R and the main body left frame 90L. That is, the cartridge 50 is attachable to and detachable from the housing 76.

The connection portion 64 is a connection member connected to each of the main body right frame 90R and the main body left frame 90L, and is formed of a sheet metal in the present exemplary embodiment. An end portion of the connection portion 64 on the +Y direction side is connected to an end portion of the main body right frame 90R on the −Z direction side. An end portion of the connection portion 64 on the −Y direction side is connected to an end portion of the main body left frame 90L on the −Z direction side. The distance between a downstream end portion of the housing 76 in the +X direction and the connection portion 64 is shorter than the distance between an upstream end portion of the housing 76 in the +X direction and the connection portion 64. Further, the connection portion 64 (downstream connection portion) is downstream of the support portion 80R and the support portion 80L in the +X direction. Furthermore, an upper end portion of the connection portion 64 is located below an upper end portion of a first guide portion 173 described below. In addition, a part of the connection portion 64 is located below a contact surface 80Rb and a contact surface 80Lb described below.

Figure 3A:
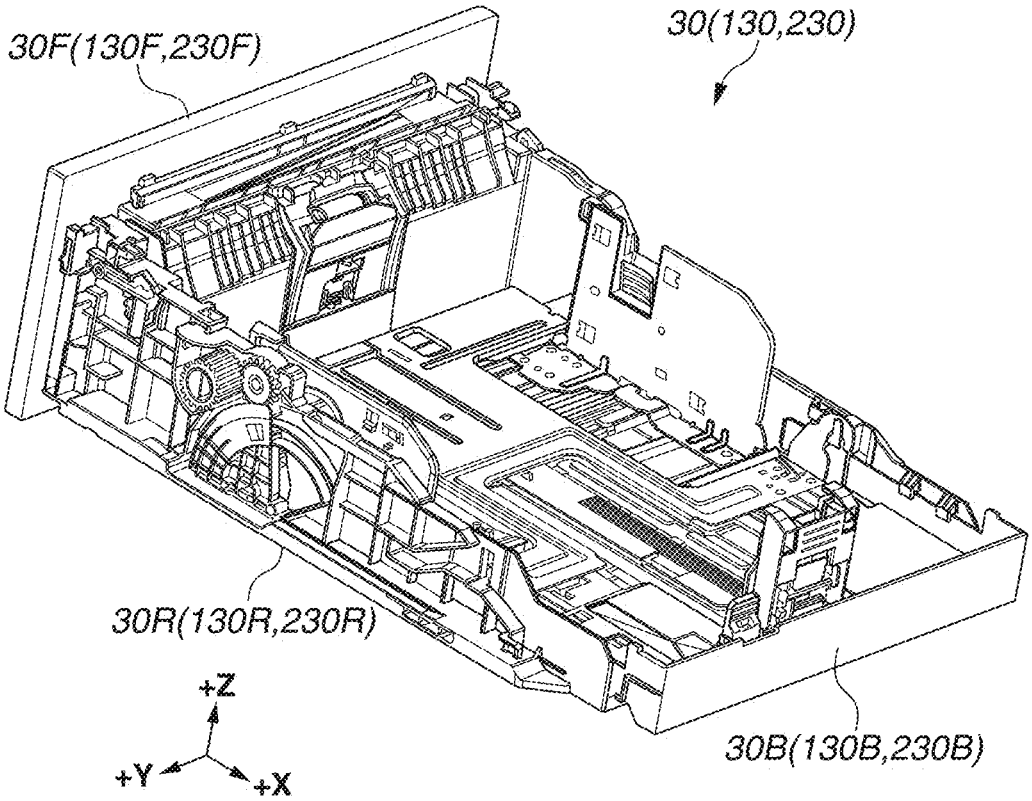
FIGS. 3A and 3B are perspective views of an accommodation portion according to the first exemplary embodiment.
Figure 3B:
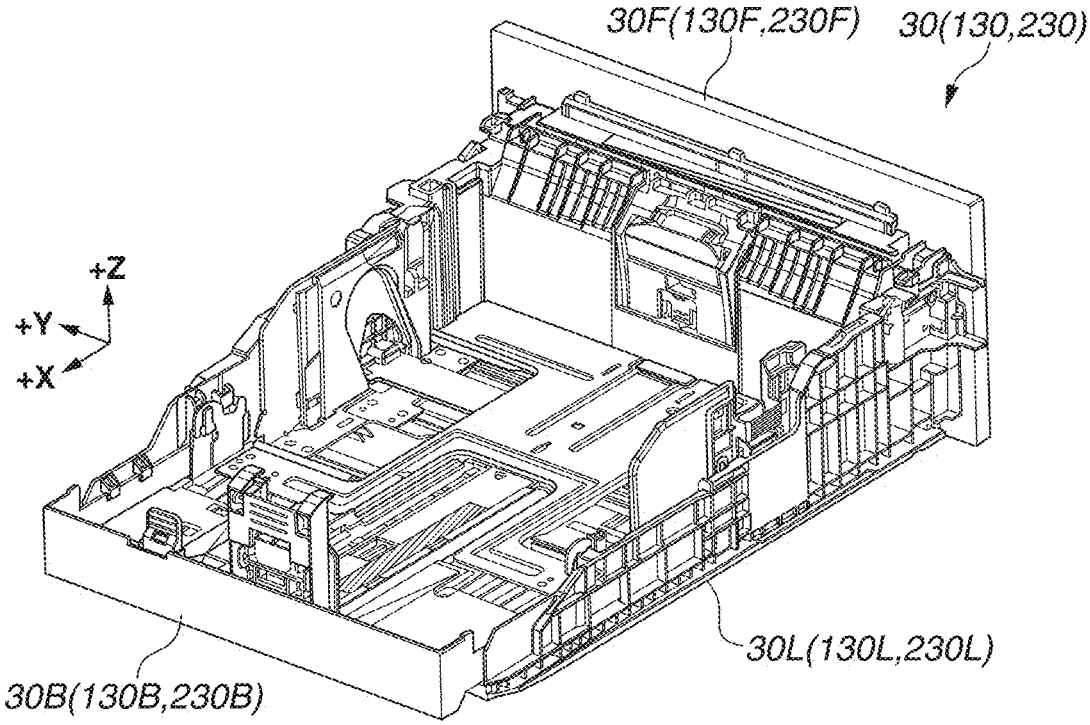
Figure 4A:
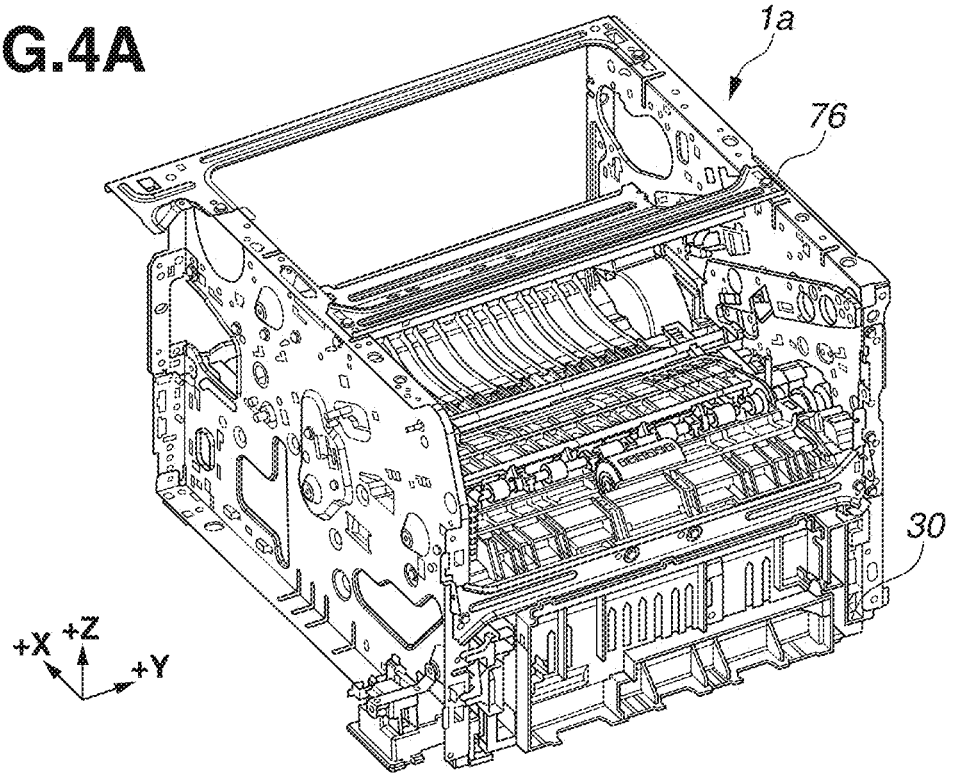
FIGS. 4A and 4B are schematic diagrams of the image formation apparatus according to the first exemplary embodiment.
Figure 4B:
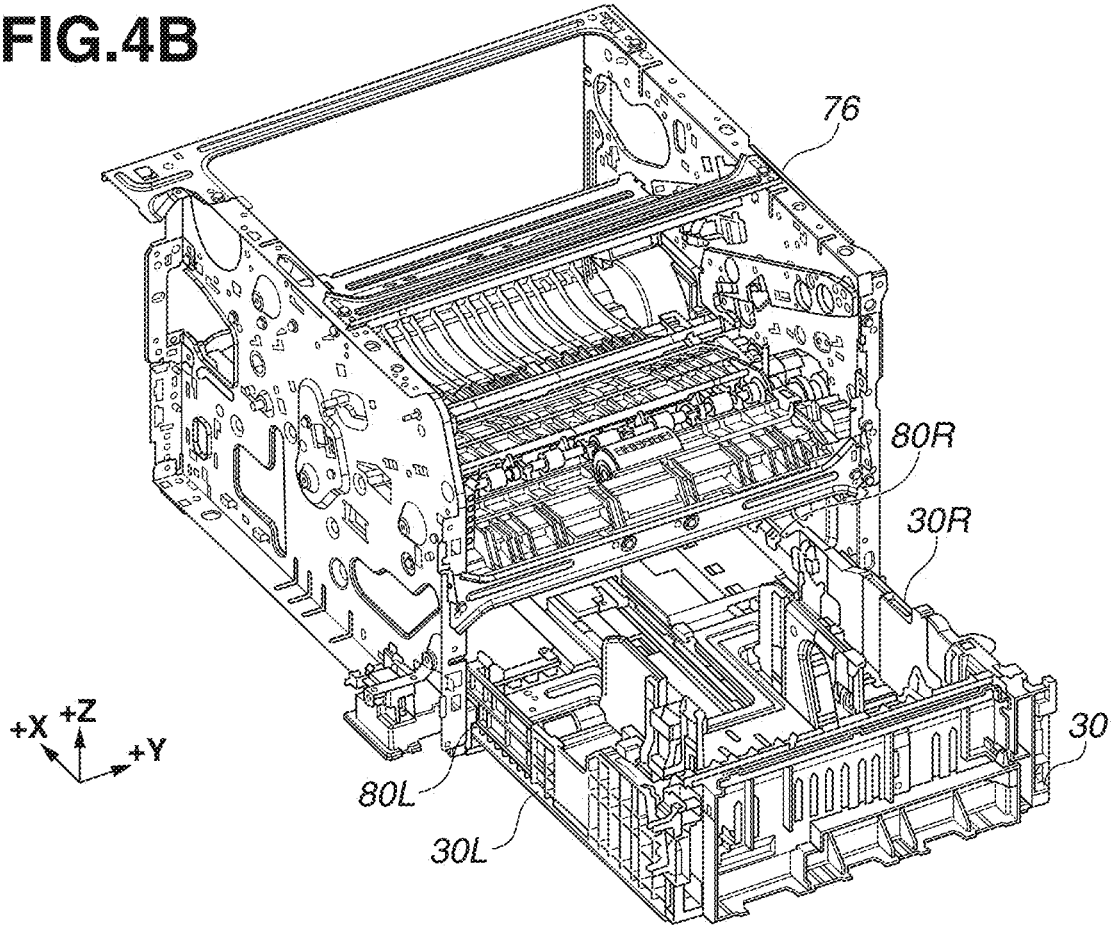

Next, a configuration of the accommodation portion 30 will be described with reference to FIGS. 3A to 4B. FIGS. 3A and 3B are each a perspective view of the accommodation portion 30. FIGS. 4A and 4B are each a perspective view of the image formation apparatus 1*a*. As illustrated in FIGS. 3A and 3B, the accommodation portion 30 has a front plate 30F, a rear plate (first rear end) 30B, a supported portion 30R, and a supported portion 30L. The front plate 30F is positioned at an end portion of the accommodation portion 30 on the −X direction side. The rear plate 30B is positioned at an end portion of the accommodation portion 30 on the +X direction side. The supported portion 30R is positioned at an end portion of the accommodation portion 30 on the +Y direction side. The supported portion 30L is positioned at an end portion of the accommodation portion 30 on the −Y direction side.

As illustrated in FIG. 4B, the supported portion 30R and the supported portion 30L are in contact with the support portion 80R and the support portion 80L, and are supported by the support portion 80R and the support portion 80L, respectively. To be more specific, the end portion of the supported portion 30R on the −Z direction side is in contact with the contact surface 80Rb which is the end portion of the support portion 80R on the +Z direction side, and the end portion of the supported portion 30L on the −Z direction side is in contact with the contact surface 80Lb which is the end portion of the support portion 80L on the +Z direction side. It can also be said that the main body right frame 90R supports the supported portion 30R, and the main body left frame 90L supports the supported portion 30L. It can also be said that the accommodation portion 30 is supported by the housing 76. That is, the accommodation portion 30 is connected to each of the main body right frame 90R and the main body left frame 90L. Further, the accommodation portion 30 is positioned between the main body right frame 90R and the main body left frame 90L in the second direction.

As illustrated in FIGS. 4A and 4B, the accommodation portion 30 can move with respect to the housing 76 to take a first position (pull-out position) (FIG. 4B) where the accommodation portion 30 is pulled out from the housing 76. Further, the accommodation portion 30 can move with respect to the housing 76 to take a second position (insertion position) (FIG. 4A) where the accommodation portion 30 is inserted into the housing 76. That is, the accommodation portion 30 can move between the first position and the second position with respect to the housing 76. The accommodation portion 30 can move from the first position to the second position by moving in the +X direction (insertion direction) with respect to the housing 76. Further, the accommodation portion 30 can move from the second position to the first position by moving in the −X direction (pull-out direction) with respect to the housing 76.

<Configuration of Accommodation Unit>

Figure 5A:
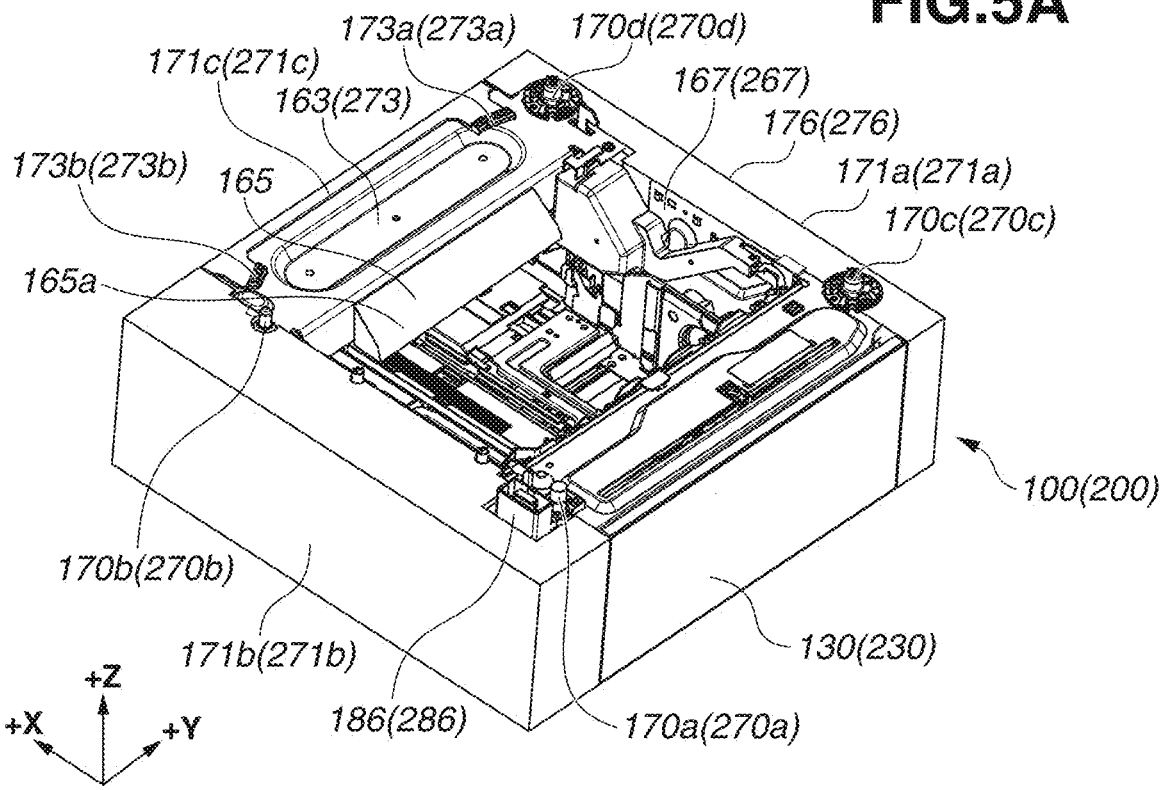
FIGS. 5A and 5B are perspective views of a first accommodation unit according to the first exemplary embodiment.
Figure 5B:
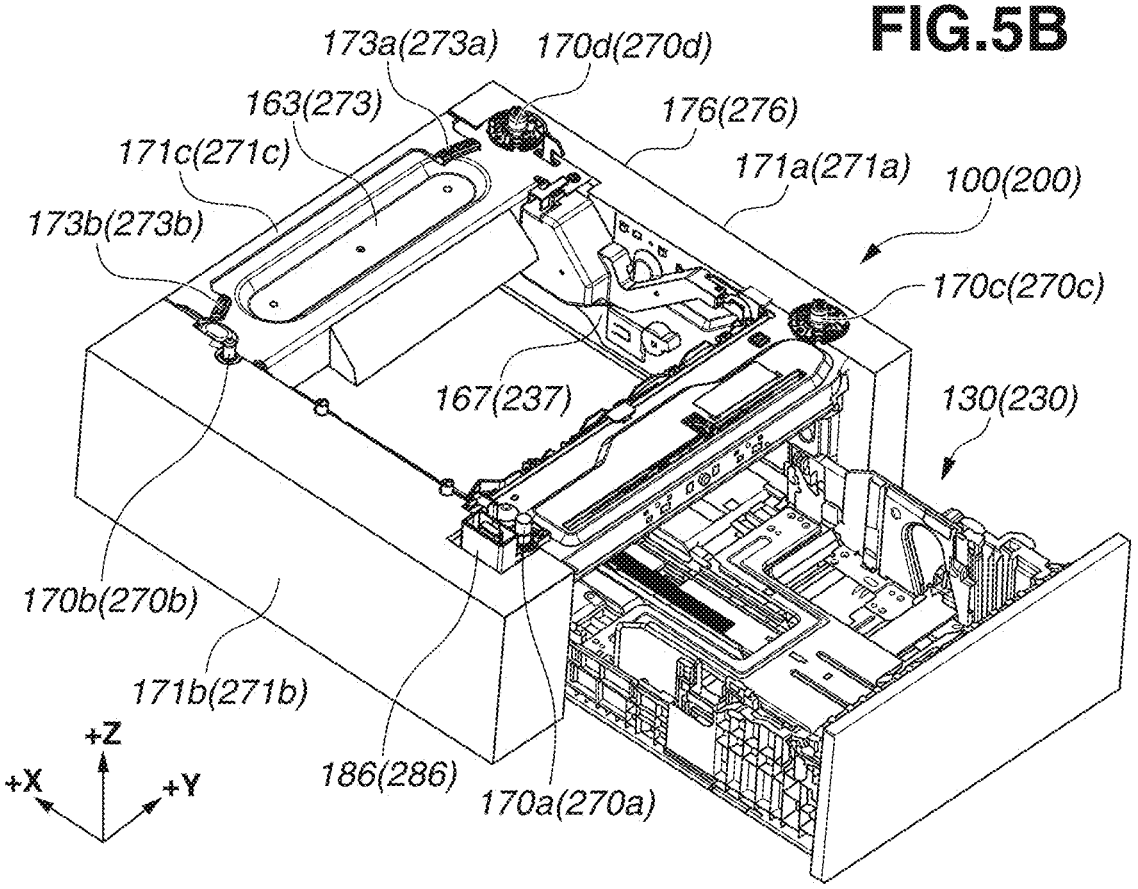
Figure 6A:
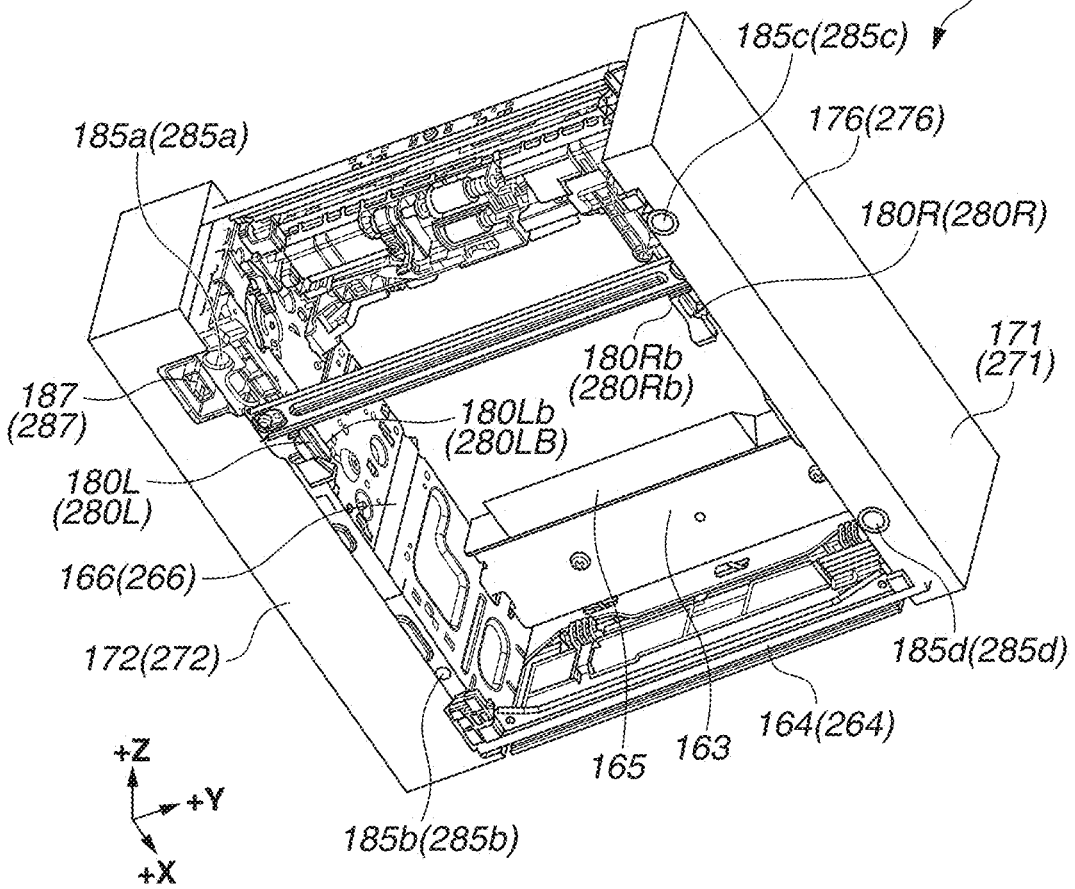
FIGS. 6A, 6B, and 6C are a perspective view of the first accommodation unit and perspective views of a first accommodation portion according to the first exemplary embodiment.
Figure 6B:
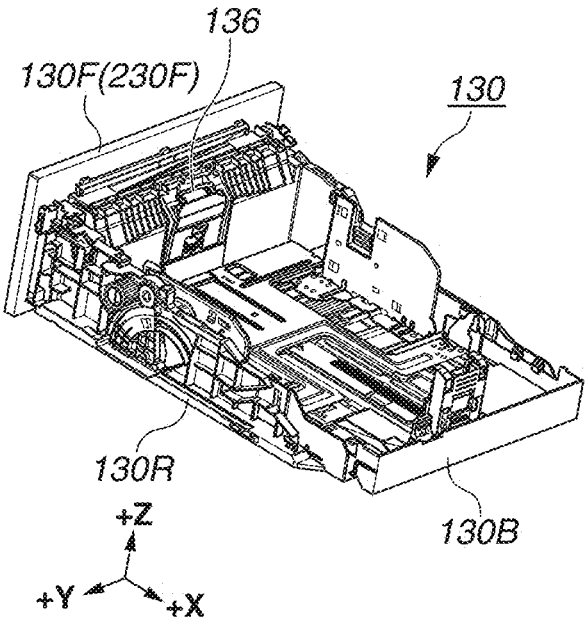
Figure 6C:
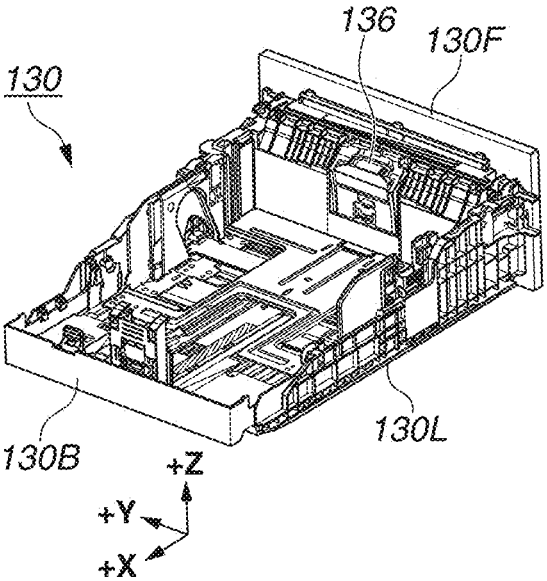

Next, configurations of the first accommodation unit 100 and the second accommodation unit 200 will be described with reference to FIGS. 1, and 5A to 6C. FIGS. 5A and 5B are each a perspective view of the first accommodation unit 100. FIG. 6A is a perspective view of the first accommodation unit 100. FIGS. 6B and 6C are perspective views of a first accommodation portion 130 described below.

The first accommodation unit 100 includes a first accommodation portion 130 capable of accommodating a recording material and a housing 176. The first accommodation portion 130 has the same configuration as the accommodation portion 30 described above. The first accommodation portion 130 includes a front plate 130F, a rear plate 130B, a first supported portion 130R, and a first supported portion 130L. The front plate 130F, the rear plate 130B, the first supported portion 130R, and the first supported portion 130L respectively correspond to the front plate 30F, the rear plate 30B, the supported portion 30R, and the supported portion 30L of the accommodation portion 30. Therefore, since the description of the accommodation portion 30 is also applied to the first accommodation portion 130, the description of the first accommodation portion 130 will be omitted.

The first housing 176 includes a right side plate 167 (third frame), a left side plate 166 (fourth frame), first engagement pins 170 (170*a*, 170*b*, 170*c*, 170*d*), a connector 186, a first connector connection portion 187, a right cover 171*a*, a left cover 171*b*, a rear cover 171*c*, first guide portions 173 (173*a*, 173*b*), a first connection portion 163, a second guide portion 165, and a second connection portion 164. As illustrated in FIG. 1, the first housing 176 has a first paper feed roller 112, a third conveyance roller 113, a first separation roller 136, and a fourth conveyance roller pair 141.

The first paper feed roller 112 conveys the bundle(S) of the recording materials accommodated in the first accommodation portion 130 to the third conveyance roller 113 and the first separation roller 136. The first separation roller 136 separates one recording material from the bundle of recording materials sent from the first paper feed roller 112. The separated recording material is conveyed to the fourth conveyance roller pair 141 by the third conveyance roller 113 and the first separation roller 136. The fourth conveyance roller pair 141 conveys the recording material toward the second conveyance roller pair 41.

The first engagement pins 170*a* to 170*d* are provided on the top surface of the first accommodation unit 100, and are engaged with the positioning hole 85*a*, the positioning hole 85*b*, the positioning hole 85*c*, and the positioning hole 85*d* of the image formation apparatus 1*a* described above. Thus, the first accommodation unit 100 is connected to the lower portion of the image formation apparatus 1*a*. The connector 186 is connected to the connector connection portion 87 described above. Thus, the image formation apparatus 1*a* and the first accommodation unit 100 are electrically connected to each other. The first connector connection portion 187 is connected to a second connector 286 described below. Thus, the second accommodation unit 200 and the first accommodation unit 100 are electrically connected to each other.

As illustrated in FIGS. 5A and 6A, the first connection portion 163 is connected to each of the right side plate 167 and the left side plate 166, so as to be positioned between the right side plate 167 and the left side plate 166 in the second direction. Similarly, the second connection portion 164 is also connected to each of the right side plate 167 and the left side plate 166, so as to be positioned between the right side plate 167 and the left side plate 166. The first connection portion 163 constitutes an end portion on the upper side (+Z direction side) of the first accommodation unit 100, and the second connection portion 164 constitutes an end portion on the lower side (−Z direction side) of the first accommodation unit 100. Further, an end portion of the first connection portion 163 on the −X direction side is located upstream of the first guide portion 173 in the +X direction. The first connection portion 163 is positioned downstream of a first support portion (first right support portion) 180R and a first support portion (first left support portion) 180L in the first direction, which will be described below. The second connection portion 164 (second downstream connection portion) is located downstream of first support portions 180R and 180L described below in the first direction. Further, an upper end portion of the second connection portion 164 is located below an upper end portion of a third guide portion 273 described below. That is, it can be said that the first guide portion 173 is located above the second connection portion 164. Further, a part of the connection portion 164 is located below a first contact surface 180Rb and a first contact surface 180Lb, which will be described below.

As illustrated in FIG. 6A, the right side plate 167 has a first support portion 180R, and the left side plate 166 has a first support portion 180L. The first supported portion 130R and the first supported portion 130L are supported by the first support portion 180R and the first support portion 180L, respectively. To be more specific, the end portion of the first supported portion 130R on the −Z direction side is in contact with the first contact surface 180Rb which is the end portion of the first support portion 180R on the +Z direction side, and the end portion of the first supported portion 130L on the −Z direction side is in contact with the first contact surface 180Lb which is the end portion of the first support portion 180L on the +Z direction side. That is, it can be said that the right side plate 167 supports the first supported portion 130R, and the left side plate 166 supports the first supported portion 130L. It can also be said that the first accommodation portion 130 is supported by the first housing 176.

As illustrated in FIG. 5B, the first accommodation portion 130 can be moved in the +X direction with respect to the first housing 176 to take a third position (pull-out position) where the first accommodation portion 130 is pulled out from the first housing 176. Further, as illustrated in FIG. 5A, the first accommodation portion 130 can move in the −X direction with respect to the first housing 176 to take a fourth position (insertion position) where the first accommodation portion 130 is inserted into the first housing 176. That is, the first accommodation portion 130 can move between the third position and the fourth position with respect to the first housing 176.

Further, as illustrated in FIG. 6A a, the first accommodation unit 100 has a first positioning hole 185*a*, a first positioning hole 185*b*, a first positioning hole 185*c*, and a first positioning hole 185*d*. The first positioning holes 185*a* to 185*d* are respectively connected to second engagement pins 270*a* to 270*d* included in the second accommodation unit 200, which will be described below. Thus, the second accommodation unit 200 is connected the lower portion of the first accommodation unit 100.

Next, a configuration of the first guide portion 173 will be described with reference to FIG. 1 and FIGS. 5A and 5B. As illustrated in FIGS. 5A and 5B, the rear cover (exterior portion) 171*c* is an exterior portion that is a downstream end portion and an upper end portion on the first direction side in the first accommodation unit 100. The rear cover 171*c* includes a first guide portion 173. The first guide portion 173 is in contact with an upper end portion of the first connection portion 163 and is located above the first connection portion 163. Further, the first guide portion 173 constitutes an end portion on the upper side (+Z direction side) of the first accommodation unit 100. Further, the first guide portion 173 is located between the right side plate 167 and the left side plate 166 in the Y direction.

As illustrated in FIG. 1, the first guide portion 173*a* and the first guide portion 173*b* have a first contact surface 175*a* and a first contact surface 175*b*, respectively. The first contact surface 175 constitutes an end portion of the first guide portion 173 on the +Z direction side. Further, the first contact surface 175 extends upward as extending in the first direction. The function of the first guide portions 173*a* and 173*b* will be described below.

Next, the second guide portion (guide portion) 165 will be described. The second guide portion 165 is provided at an upstream end portion of the first connection portion 163 in the first direction. The second guide portion 165 may be integrated with the first connection portion 163 and may be an upstream end portion of the first connection portion 163 in the first direction. An inclined surface 165*a* is formed at an end portion of the second guide portion 165 on the +Z direction side, and the inclined surface 165*a* extends upward as extending in the first direction. Further, the second guide portion 165 is located upstream of the first guide portion 173 and the connection portion 64 in the first direction. Furthermore, the second guide portion 165 is located below the first guide portion 173. The function of the second guide portion 165 will be described below.

Next, a configuration of the second accommodation unit 200 will be described with reference to FIGS. 1, and 5A to 6C. The second accommodation unit 200 is different from the first accommodation unit 100 only in that the second accommodation unit 200 does not include the second guide portion 165 included in the first accommodation unit 100, and other configurations are the same as the configuration of the first accommodation unit 100.

The second accommodation unit 200 includes a second accommodation portion 230 and a second housing 276. The second accommodation portion 230 includes a front plate 230F, a rear plate 230B, a second supported portion 230R, and a second supported portion 230L. The second accommodation portion 230 has the same configuration as the accommodation portion 30 described above. That is, the front plate 230F, the rear plate 230B, the second supported portion 230R, and the second supported portion 230L respectively correspond to the front plate 30F, the rear plate 30B, the supported portion 30R, and the supported portion 30L of the accommodation portion 30. Therefore, since the description of the accommodation portion 30 is also applied to the second accommodation portion 230, the description will be omitted.

Further, the second housing 276 includes a second right side plate 267 (fifth frame), a second left side plate 266 (sixth frame), second engagement pins 270 (270*a*, 270*b*, 270*c*, 270*d*), a second connector 286, a second connector connection portion 287, a second right cover 271*a*, a second left cover 271*b*, a second rear cover 271*c*, third guide portions 273 (273*a*, 273*b*), a third connection portion 263, and a fourth connection portion 264. Furthermore, the second housing 276 has a second paper feed roller 212, a fifth conveyance roller 213, a second separation roller 236, and a sixth conveyance roller pair 241.

In addition, the third guide portion 273*a* and the third guide portion 273*b* respectively include a second contact surface 275*a* and a second contact surface 275*b*.

Further, the second right side plate 267 has a second support portion (second right support portion) 280R, and the second left side plate 266 has a first support portion (second left support portion) 280L.

Furthermore, the second accommodation unit 200 has second positioning holes 285*a* to 285*d*. The second positioning holes 285*a* to 285*d* are respectively connected to third engagement pins 380*a* to 380*d* included in the support unit 300, which will be described below. Thus, the support unit 300 is connected the lower portion of the second accommodation unit 200.

The second accommodation portion 230 can be moved in the −X direction with respect to the second housing 276 to take a fifth position (pull-out position) where the second accommodation portion 230 is pulled out from the second housing 276, as illustrated in FIG. 5B, and can be moved in the +X direction with respect to the second housing 276 to take a sixth position (insertion position) where the second accommodation portion 230 is inserted into the second housing 276, as illustrated FIG. 5A. That is, the second accommodation portion 230 can move between the fifth position and the sixth position with respect to the second housing 276.

Since each configuration of the second accommodation unit 200 described above is identical to the configuration of the first accommodation unit 100, a description thereof will be omitted.

<Configuration of Support Unit 300>

Figure 7:
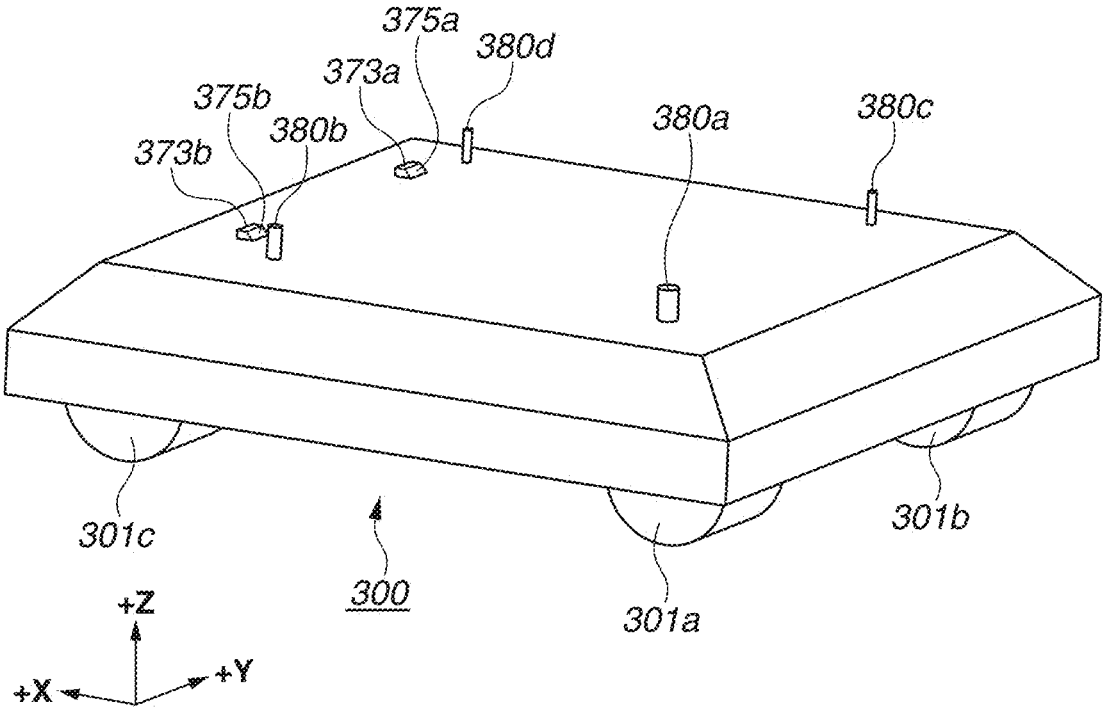
FIG. 7 is a perspective view of a support unit according to the first exemplary embodiment.

Next, a configuration of the support unit 300 will be described with reference to FIG. 7. FIG. 7 is a perspective view of the support unit 300. The support unit 300 includes fourth guide portions 373*a* and 373*b*, third engagement pins 380*a* to 380*d*, and casters 301*a* to 301*d*.

The fourth guide portion 373 constitutes an end portion of the support unit 300 on the +Z direction side. The fourth guide portion 373*a* and the fourth guide portion 373*b* respectively have a third contact surface 375*a* and a third contact surface 375*b*. The third contact surfaces 375*a* to 375*b* constitute an end portion of the fourth guide portion 373 on the +Z direction side. Further, each of the third contact surface 375*a* and the third contact surface 375*b* extends upward as extending in the first direction.

<Hanging Down of Accommodation Portion 30>

Figure 8A:
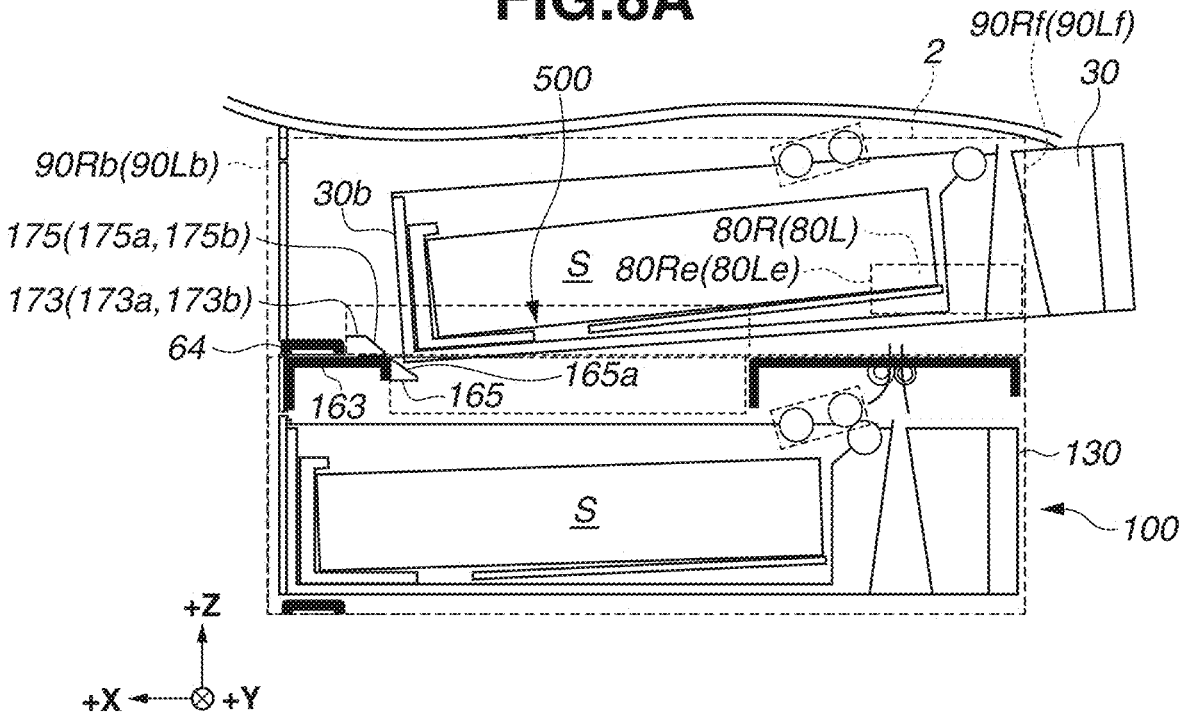
FIGS. 8A and 8B are plan views of the accommodation portion and the first accommodation unit according to the first exemplary embodiment.
Figure 8B:
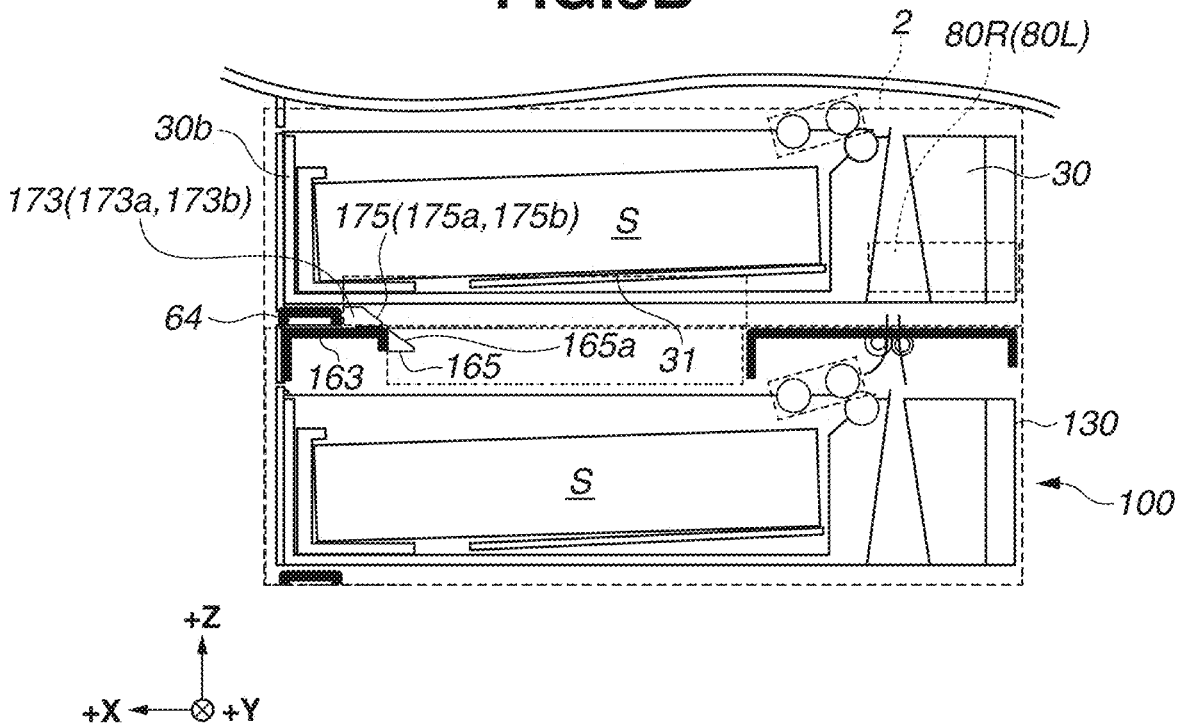

Next, the hanging down of the accommodation portion 30 during insertion will be described with reference to FIGS. 8A and 8B. FIGS. 8A and 8B are each a plan view of the accommodation portion 30 and the first accommodation unit 100.

In the following description, a unit capable of accommodating a recording material may be referred to as an accommodation unit, and a unit connected below the accommodation unit may be referred to as a connection unit. For example, the image formation apparatus 1*a* according to the present exemplary embodiment can be referred to as an accommodation unit, and the first accommodation unit 100 can be referred to as a connection unit. Further, the first accommodation unit 100 may be referred to as an accommodation unit, and the second accommodation unit 200 may be referred to as a connection unit. Furthermore, the second accommodation unit 200 may be referred to as an accommodation unit, and the support unit 300 may be referred to as a connection unit.

A case where the accommodation portion 30 of the image formation apparatus 1*a* (accommodation unit) hangs down toward the first accommodation unit 100 (connection unit) will be described.

As illustrated in FIG. 8A, in a case where the accommodation portion 30 moves from the first position to the second position, the +X direction side of the accommodation portion 30 may hang down in the −Z direction. The causes of the hanging down of the accommodation portion 30 are related to, for example, the number of sheets of the recording material accommodated in the accommodation portion 30, the configuration of the support portion 80, and a space 500 described below.

First, the arrangement of the support portion 80 will be described with reference to FIGS. 8A and 8B. The end portion 80Re is a downstream end portion of the support portion 80R in the first direction (+X direction). The end portion 80Le is a downstream end portion of the support portion 80L in the first direction (+X direction). The end portion 90Rb is a downstream end portion of the main body right frame 90R in the first direction (+X direction). The end portion 90Lb is a downstream end portion of the main body left frame 90L in the first direction (+X direction). The end portion 90Rf is an upstream end portion of the main body right frame 90R in the first direction (+X direction). The end portion 90Lf is an upstream end portion of the main body left frame 90L in the first direction (+X direction).

As illustrated in FIGS. 8A and 8B, the shortest length between the end portion 80Re and the end portion 90Rf in the first direction is shorter than the shortest length between the end portion 80Re and the end portion 90Rb in the first direction. Further, as illustrated in FIGS. 8A and 8B, the shortest length between the end portion 80Le and the end portion 90Lf in the first direction is shorter than the shortest length between the end portion 80Le and the end portion 90Lb in the first direction.

Figure 9A:
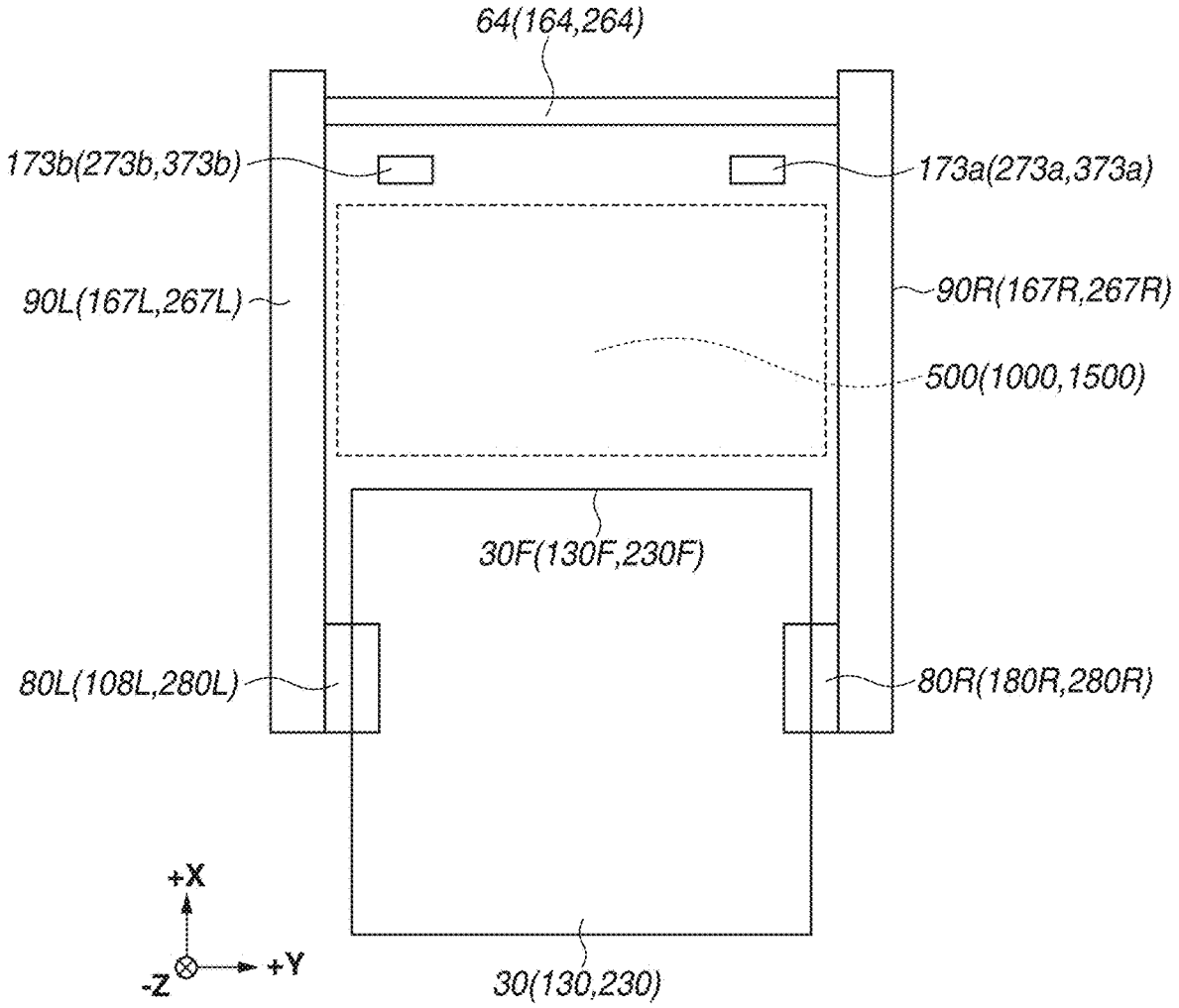
FIGS. 9A and 9B are plan views of the accommodation unit and a connection unit according to the first exemplary embodiment.
Figure 9B:
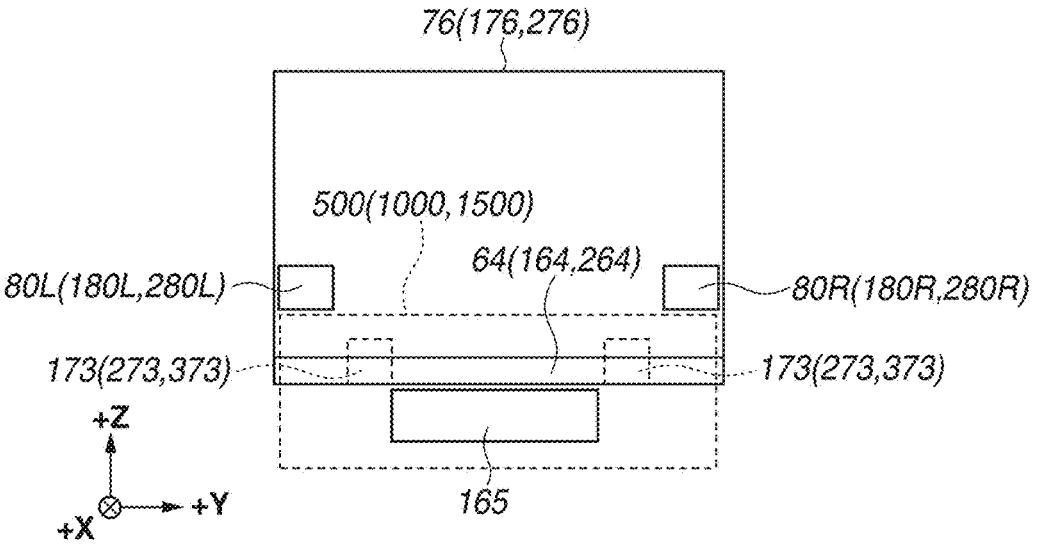

Next, a space 500 will be described with reference to FIGS. 8A to 9B. FIGS. 9A and 9B are plan views illustrating a part of the accommodation unit and a part of the connection unit.

As illustrated in FIG. 9A, the space 500 exists between the image formation apparatus 1*a* and the inside of the first accommodation unit 100. The space 500 is positioned between the main body right frame 90R and the main body left frame 90L in the second direction (Y direction). Further, the length of the space 500 in the second direction is longer than the length of the rear plate 30B, which is the downstream end portion of the accommodation portion 30 in the first direction (+X direction side), in the second direction. Furthermore, as illustrated in FIGS. 9A and 9B, the length of the space 500 in the first direction is shorter than the length of the accommodation portion 30 in the first direction. In addition, the length of the space 500 in the first direction is longer than the length of the support portion 80 in the first direction.

The space 500 is located downstream in the first direction with respect to the support portion 80R and the support portion 80L. Further, as illustrated in FIGS. 8A and 8B, the space 500 is located below the support portion 80R and the support portion 80L in the vertical direction. Further, as illustrated in FIGS. 8A and 8B, the space 500 is located above the first accommodation portion 130 in the vertical direction.

As illustrated in FIG. 9B, the space 500 is located below the support portion 80R and the support portion 80L. When viewed in the first direction, the space 500 overlaps with each of the connection portion 64, the first guide portion 173, and the second guide portion 165.

In the process of the accommodation portion 30 moving from the first position to the second position, the rear plate 30B, which is the end portion of the accommodation portion 30 on the first direction side, reaches downstream of the support portion 80R and the support portion 80L in the first direction. In a case where the accommodation portion 30 further moves in the first direction, the rear plate 30B enters the space 500 and moves downward (FIG. 8A). At this time, at least a part of the accommodation portion 30 enters the space 500 and is positioned below the upper end of the connection portion 64.

In a case where the first guide portion 173 and the second guide portion 165 are not provided in the first accommodation unit 100, the rear plate 30B may interfere with the upstream end portion of the connection portion 64 in the first direction or the upstream end portion of the first connection portion 163 in the first direction, and the insertion of the accommodation portion 30 may be hindered. Further, in a case where the number of sheets of the recording material accommodated in the accommodation portion 30 is large, the weight of the entire accommodation portion 30 is increased, and thus the possibility of hanging down is further increased.

Accordingly, in the present exemplary embodiment, the first guide portion 173 and the second guide portion 165 are provided in such a manner that the insertion of the accommodation portion 30 is not hindered. The first guide portion 173 and the second guide portion 165 are positioned in the space 500. To be more specific, the first contact surface 175 of the first guide portion 173 and the inclined surface 165*a* of the second guide portion 165 are positioned in the space 500.

In the process of the accommodation portion 30 moving from the first position to the second position, the rear plate 30B of the accommodation portion 30 enters the space 500. Further, when the accommodation portion 30 moves from the first position to the second position, the accommodation portion 30 comes into contact with each of the first guide portion 173 and the second guide portion 165, and is guided upward. To be more specific, in the process of the accommodation portion 30 moving from the first position to the second position, the accommodation portion 30 is guided upward by coming into contact with the first contact surface 175 of the first guide portion 173 and the inclined surface 165*a* of the second guide portion 165.

The upper end of the first guide portion 173 is higher than the connection portion 64. Therefore, the accommodation portion 30 is guided by the first guide portion 173 to a position above the connection portion 64. As a result, the accommodation portion 30 is prevented from coming into contact with the accommodation portion 130 and the connection portion 64. Finally, the accommodation portion 30 can reach the second position, as illustrated in FIG. 8B. When the accommodation portion 30 is at the second position, the downstream end portion of the accommodation portion 30 is positioned downstream of the upstream end portion of the connection portion 64 in the +X direction.

It can also be said that the first guide portion 173 and the second guide portion 165 are guide members that come into contact with the accommodation portion 30 and guide the accommodation portion 30 upward in the process of the accommodation portion 30 moving from the first position to the second position.

<Hanging Down of Accommodation Portion 130>

In the above description, the hanging down of the accommodation portion 30 has been described. A case where the first accommodation portion 130 of the first accommodation unit 100 (accommodation unit) hangs down toward the second accommodation unit 200 (connection unit) will be described. The above description of the hanging down of the accommodation portion 30 also applies to the hanging down of the first accommodation portion 130, and thus a detailed description thereof will be omitted.

Figure 10A:
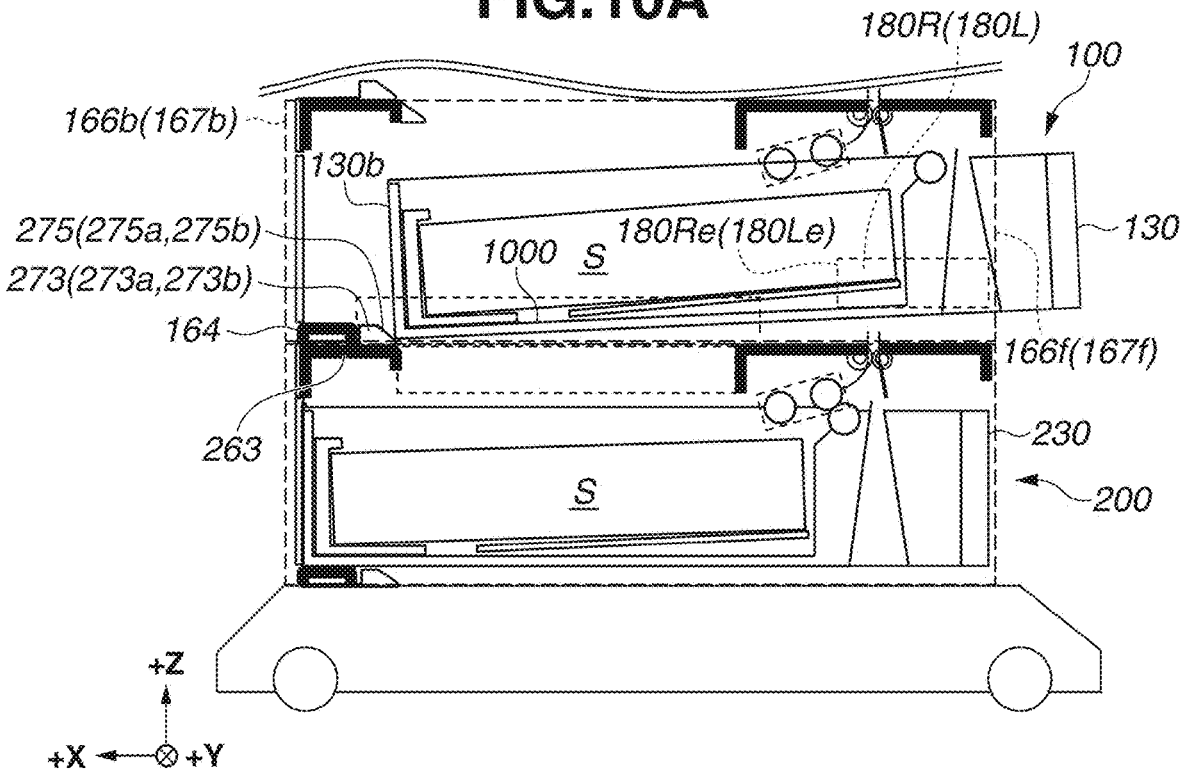
FIGS. 10A and 10B are plan views of the first accommodation unit and a second accommodation unit according to the first exemplary embodiment.
Figure 10B:
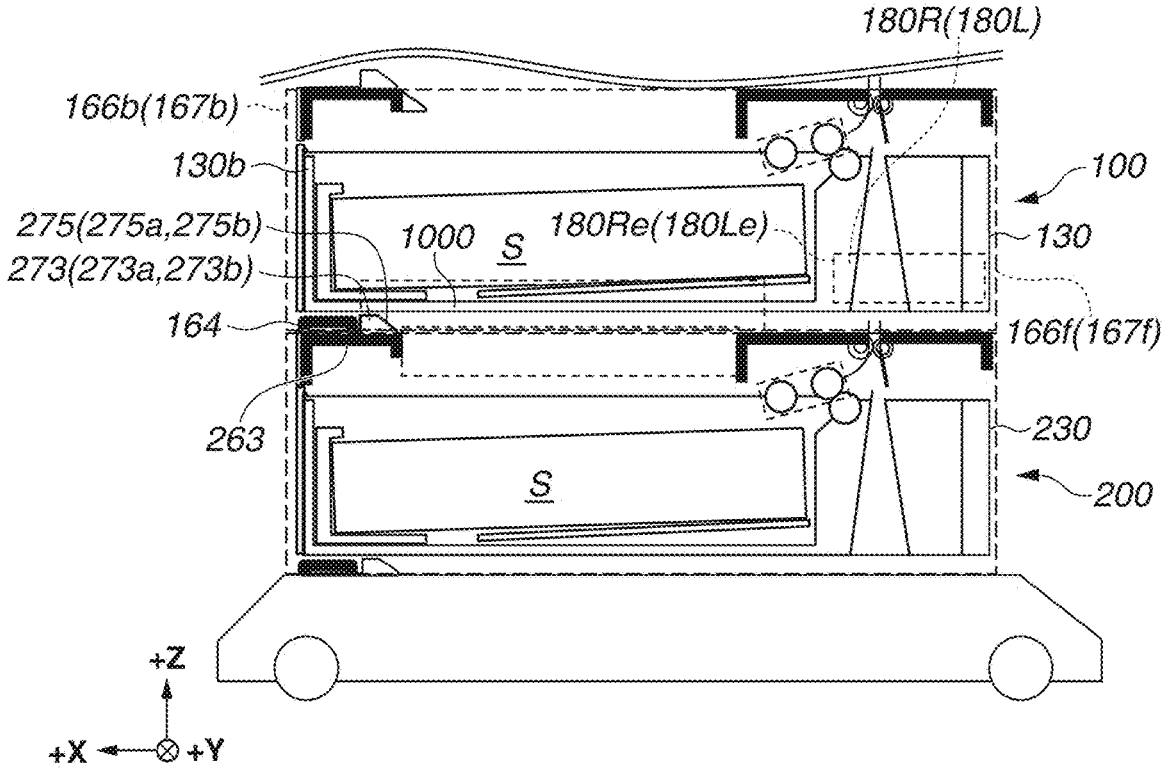

In the process of the first accommodation portion 130 moving from the third position to the fourth position, the rear plate 130B of the first accommodation portion 130 enters a space 1000. Further, when the first accommodation portion 130 moves from the third position to the fourth position, the first accommodation portion 130 comes into contact with the third guide portion 273 and is guided upward. To be more specific, the first accommodation portion 130 is guided upward by coming into contact with the second contact surface 275 of the third guide portion 273. As illustrated in FIG. 10B, the first accommodation portion 130 can reach the fourth position by being guided by the third guide portion 273.

The upper end of the third guide portion 273 is higher than the second connection portion 164. Therefore, the first accommodation portion 130 is guided by the third guide portion 273 to a position above the second connection portion 164. As a result, the first accommodation portion 130 is prevented from coming into contact with the second accommodation portion 230 and the second connection portion 164. Finally, the first accommodation portion 130 can reach the fourth position, as illustrated in FIG. 10B. When the first accommodation portion 130 is at the fourth position, the downstream end portion of the first accommodation portion 130 is positioned downstream of the upstream end portion of the second connection portion 164 in the +X direction.

It can also be said that the third guide portion 273 is a guide member that comes into contact with the first accommodation portion 130 and guides the first accommodation portion 130 upward in the process of the first accommodation portion 130 moving from the third position to the fourth position.

<Hanging Down of Second Accommodation Portion 230 >

Figure 11A:
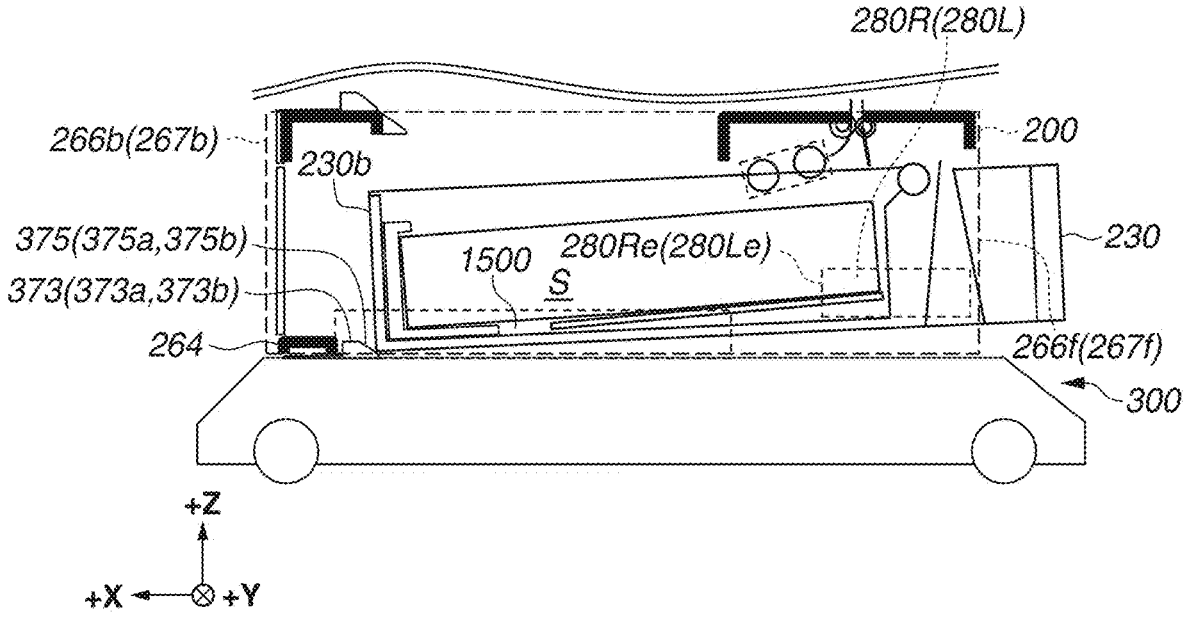
FIGS. 11A and 11B are plan views of the second accommodation unit and the support unit according to the first exemplary embodiment.
Figure 11B:
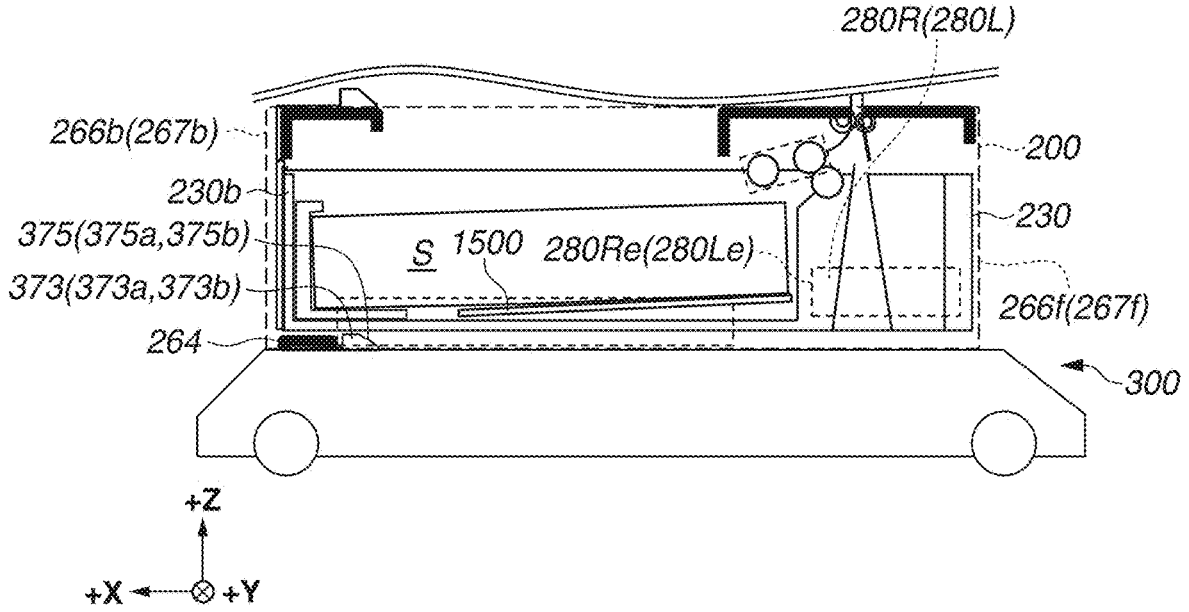

In the above description, the hanging down of the accommodation portion 30 has been described. A case where the second accommodation portion 230 of the second accommodation unit 200 (accommodation unit) hangs down toward the support unit 300 (connection unit) will be described. FIGS. 11A and 11B are each a plan view of the second accommodation unit 200 and the support unit 300. The above description of the hanging down of the accommodation portion 30 also applies to the hanging down of the second accommodation portion 230, and thus a detailed description thereof will be omitted. It has been described that the space 500 is located above the first accommodation portion 130 in the vertical direction, however, a space 1500 illustrated in FIGS. 11A and 11B is located above the support unit 300.

In the process of the second accommodation portion 230 moving from the fifth position to the sixth position, the rear plate 230B of the second accommodation portion 230 enters the space 1500. Further, when the second accommodation portion 230 moves from the fifth position to the sixth position, the second accommodation portion 230 comes into contact with the fourth guide portion 373 and is guided upward. To be more specific, the second accommodation portion 230 is guided upward by coming into contact with the third contact surface 375 of the fourth guide portion 373. As illustrated in FIG. 11B, the second accommodation portion 230 can reach the sixth position by being guided by the fourth guide portion 373.

The upper end of the fourth guide portion 373 is higher than the fourth connection portion 264. Therefore, the second accommodation portion 230 is guided by the fourth guide portion 373 to a position above the fourth connection portion 264. As a result, the second accommodation portion 230 is prevented from coming into contact with the support unit 300 and the fourth connection portion 264. Finally, the second accommodation portion 230 can reach the sixth position, as illustrated in FIG. 11B. When the second accommodation portion 230 is at the sixth position, the downstream end portion of the second accommodation portion 230 is positioned downstream of the upstream end portion of the fourth connection portion 264 in the +X direction.

It can also be said that the fourth guide portion 373 is a guide member that comes into contact with the second accommodation portion 230 and guides the second accommodation portion 230 upward in the process of the second accommodation portion 230 moving from the fifth position to the sixth position.

Modification Examples

Figure 12A:
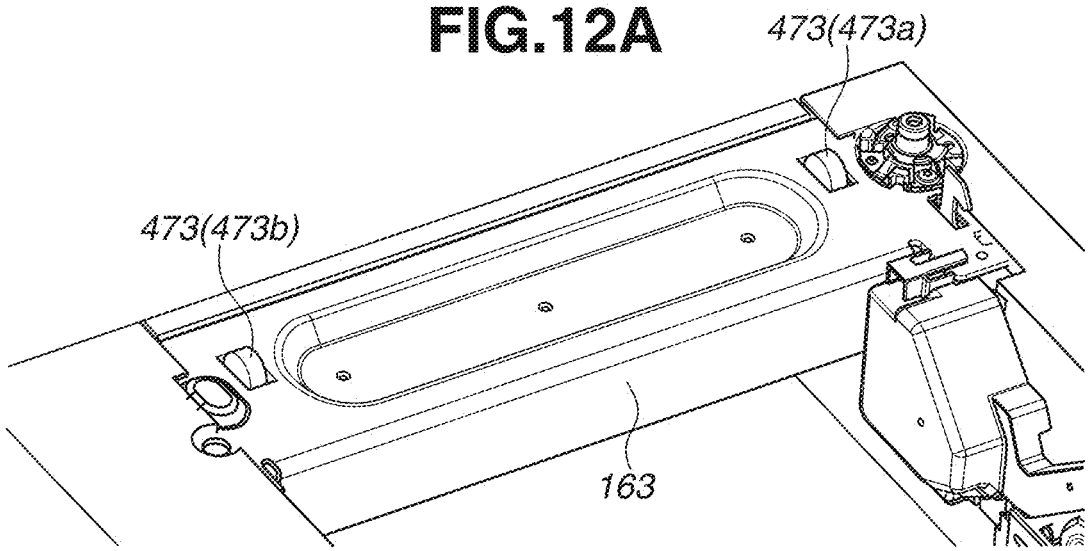
FIGS. 12A to 12C are perspective views of a first accommodation unit according to a modification example.
Figure 12B:
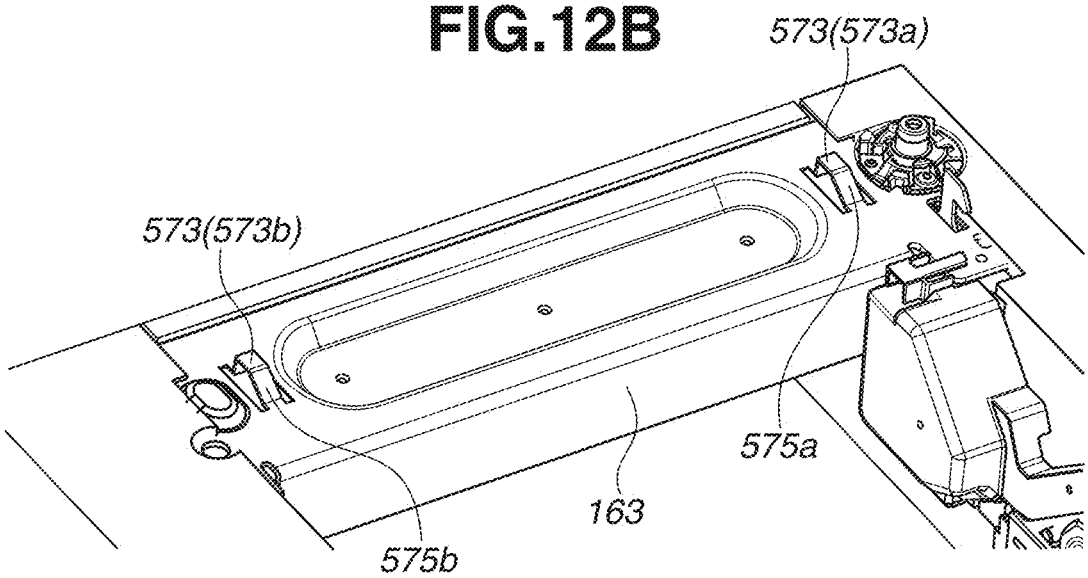
Figure 12C:
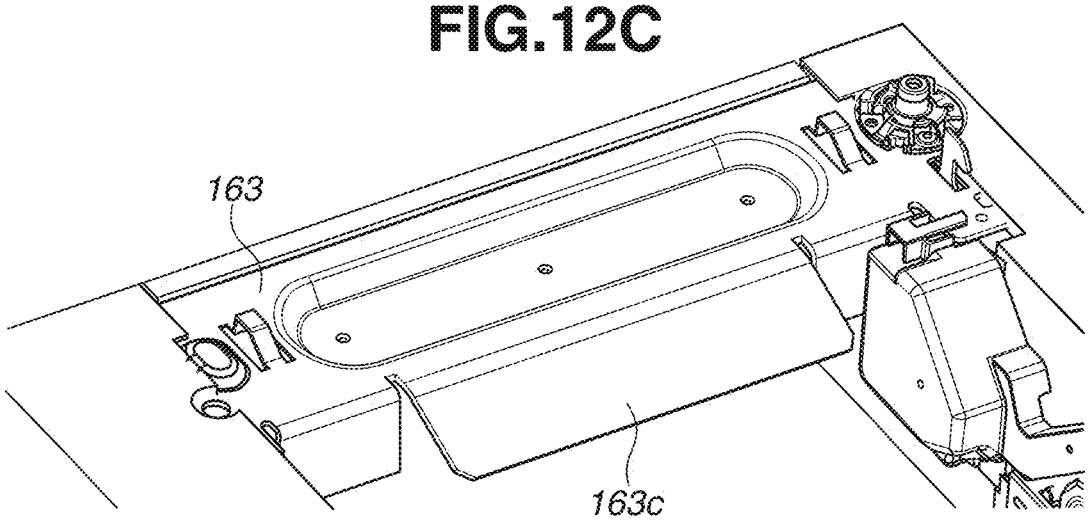

Next, modification examples to which the present invention can be applied will be described with reference to FIGS. 12A to 12C. FIGS. 12A to 12C are perspective views of the first accommodation unit 100 illustrating first to third modification examples, respectively. The shape of the first guide portion 173 described in the first exemplary embodiment may be any shape as long as the first guide portion 173 can guide the accommodation portion 30 upward, and the shape of the first guide portion 173 may be changed to a shape illustrated in FIGS. 12A and 12B described below. Similarly, the shapes of the third guide portion 273 and the fourth guide portion 373 may be changed to the shapes illustrated in FIGS. 12A and 12B. Further, the shape of the second guide portion 165 described in the first exemplary embodiment may be any shape as long as the second guide portion 165 can guide the accommodation portion 30 upward, and the shape of the second guide portion 165 may be changed to a shape illustrated in FIG. 12C described below.

In the following description, an example where the shapes of FIGS. 12A to 12C are applied to the first accommodation unit 100 according to the first exemplary embodiment will be described, but the shapes of FIGS. 12A to 12C may be applied to the third guide portion 273 of the second accommodation unit 200 or the fourth guide portion 373 of the support unit 300.

FIG. 12A illustrates a first modification example. A fifth guide portion 473 is a rotary member that is provided in the first connection portion 163 and is rotatable about the second direction (Y direction). The fifth guide portion 473 guides the accommodation portion 30 upward by rotating about the second direction when coming into contact with the accommodation portion 30.

FIG. 12B illustrates a second modification example. A sixth guide portion 573 is different from the first exemplary embodiment in that the sixth guide portion 573 is a part of the first connection portion 163. The sixth guide portion 573 has a sixth contact surface 575. The sixth contact surface 575 comes into contact with the inserted accommodation portion 30 and guides the accommodation portion 30 upward.

FIG. 12C illustrates a third modification example. An end portion of the first connection portion 163 on the −X direction side has an inclined surface 163*c*. Therefore, in a case where the inclined surface 163*c* comes into contact with the accommodation portion 30, the inclined surface 163*c* guides the accommodation portion 30 upward.

The shapes of the first guide portion 173, the second guide portion 165, the third guide portion 273, and the fourth guide portion 373 described in the first exemplary embodiment may be appropriately changed without being limited to the modification examples of FIGS. 12A to 12C. For example, the shape of the first guide portion 173 may be any shape as long as the first guide portion 173 comes into contact with the accommodation portion 30 and guides the accommodation portion 30 upward when the accommodation portion 30 moves from the first position to the second position.

The first exemplary embodiment and the modification examples have been described above as examples to which the present invention can be applied.

In the first exemplary embodiment, the first accommodation unit 100 is connected to the lower portion of the image formation apparatus 1*a*, the second accommodation unit 200 is connected to the lower portion of the first accommodation unit 100, and the support unit 300 is connected to the lower portion of the second accommodation unit 200. However, the number and order of the units to be connected may be changed as appropriate. For example, an accommodation unit having the same configuration as the first accommodation unit 100 may be further added to the image formation unit 1 described in the first exemplary embodiment between the second accommodation unit 200 and the support unit 300. Further, for example, in the image formation unit 1 described in the first exemplary embodiment, the second accommodation unit 200 may be connected to the lower portion of the image formation apparatus 1*a*. Furthermore, the support unit 300 may be connected to the lower portion of the image formation apparatus 1*a*.

The second accommodation unit 200 according to the first exemplary embodiment does not include the second guide portion 165, however, the second accommodation unit 200 may include the second guide portion 165.

In the first exemplary embodiment, the first guide portion 173 includes two guide portions, that is, the first guide portion 173*a* and the first guide portion 173*b*. However, the number of guide portions of the first guide portion 173 may be one or more.

According to the present invention, in the process of inserting the accommodation portion into the housing, it is possible to guide the accommodation portion in such a manner that the insertion of the accommodation portion is not hindered.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2023-200407, filed Nov. 28, 2023, which is hereby incorporated by reference herein in its entirety.

What is claimed is:

1. An accommodation system including an accommodation unit configured to accommodate a recording material and a connection unit configured to be connected to a lower portion of the accommodation unit, the accommodation unit including: a housing; and an accommodation portion configured to accommodate the recording material and to be movable between a first position where the accommodation portion is pulled out from the housing and a second position where the accommodation portion is inserted into the housing, the connection unit including a guide portion configured to guide a movement of the accommodation portion, wherein in a process of the accommodation portion moving in a first direction where the accommodation portion moves from the first position to the second position, the accommodation portion comes into contact with the guide portion and is guided upward, wherein the housing includes a first frame extending in the first direction, a second frame extending in the first direction, wherein the accommodation portion is located between the first frame and the second frame in a second direction orthogonal to each of the first direction and a vertical direction, wherein the first frame includes a first support portion configured to come into contact with and support the accommodation portion, and wherein the second frame includes a second support portion configured to come into contact with and support the accommodation portion.

2. The accommodation system according to claim 1, wherein a space is formed between the first frame and the second frame in the second direction, wherein the space is located downstream in the first direction and below in the vertical direction with respect to each of the first support portion and the second support portion, wherein the accommodation portion has a first rear end that is a downstream end portion of the accommodation portion in the first direction, wherein a length of the space in the second direction is longer than a length of the first rear end in the second direction, and wherein in a process of the accommodation portion moving from the first position to the second position, in a case where the first rear end reaches downstream of the first support portion and the second support portion in the first direction and the accommodation portion further moves in the first direction, the first rear end enters the space and moves downward.

3. The accommodation system according to claim 2, wherein the connection unit includes a downstream connection portion connected to each of the first frame and the second frame so as to be positioned between the first frame and the second frame in the second direction, wherein the downstream connection portion is located downstream of the guide portion in the first direction, wherein an upper end portion of the downstream connection portion is located below an upper end portion of the guide portion, and wherein the downstream connection portion and the guide portion overlap with the space when viewed in the first direction.

4. The accommodation system according to claim 3, wherein the guide portion has a contact surface, wherein the contact surface extends in the first direction where the accommodation portion moves from the first position to the second position, and extends upward as the contact surface extends in the first direction, and wherein in a process of the accommodation portion moving from the first position to the second position, the accommodation portion comes into contact with the contact surface and is guided upward.

5. The accommodation system according to claim 4, wherein the contact surface is within the space.

6. The accommodation system according to claim 2, wherein the connection unit includes a connection portion connected to each of the first frame and the second frame so as to be located between the first frame and the second frame in the second direction, and wherein the connection portion is positioned downstream of the first support portion and the second support portion in the first direction, and the guide portion is in contact with an upper end portion of the connection portion and is located above the connection portion.

7. The accommodation system according to claim 6, wherein the connection unit includes the guide portion at an upstream end portion of the connection portion in the first direction, and wherein in a process of the accommodation portion moving from the first position to the second position, the accommodation portion comes into contact with the guide portion and is guided upward.

8. The accommodation system according to claim 1, wherein in the first direction, a shortest distance between a downstream end portion of the first support portion and an upstream end portion of the first frame is shorter than a shortest distance between the downstream end portion of the first support portion and a downstream end portion of the first frame.

9. The accommodation system according to claim 1, wherein the connection unit has an exterior portion that is a downstream end portion of the connection unit in the first direction and an upper end portion of the connection unit, and wherein the exterior portion includes the guide portion.

* * * * *